US006914993B2

(12) United States Patent
Watanabe

(10) Patent No.: US 6,914,993 B2
(45) Date of Patent: Jul. 5, 2005

(54) PIEZOELECTRIC FILM LOUDSPEAKER

(75) Inventor: Shigeru Watanabe, Yamagata-ken (JP)

(73) Assignees: Pioneer Corporation, Tokyo (JP); Tohoku Pioneer Corporation, Yamagata-ken (JP)

( * ) Notice: Subject to any disclaimer, the term of this patent is extended or adjusted under 35 U.S.C. 154(b) by 0 days.

(21) Appl. No.: 10/263,651

(22) Filed: Oct. 4, 2002

(65) Prior Publication Data

US 2003/0081802 A1 May 1, 2003

(30) Foreign Application Priority Data

Nov. 1, 2001 (JP) ..... 2001-336201

(51) Int. Cl.[7] ..... H04R 25/00

(52) U.S. Cl. ..... 381/190; 381/173; 381/423; 381/353

(58) Field of Search ..... 381/190, 191, 381/114, 173, 423, 424, 353, 354; 310/324, 800, 365, 366, 367; 29/25.35

(56) References Cited

U.S. PATENT DOCUMENTS 4,056,742 A * 11/1977 Tibbetts ..... 381/190
4,985,926 A * 1/1991 Foster ..... 381/190
6,111,967 A * 8/2000 Face, Jr. et al. ..... 381/190

* cited by examiner

*Primary Examiner*—Huyen D. Le
(74) *Attorney, Agent, or Firm*—Arent Fox PLLC

(57) ABSTRACT

A piezoelectric film loudspeaker comprising a diaphragm having a flexible piezoelectric film and electrodes formed on the both surfaces of the flexible piezoelectric film and a frame for supporting a side of the diaphragm, wherein said respective electrodes disposed on the both surfaces are divided into a plurality of sections. Each area of the divided electrodes is formed differently from one another, and each curvature of the film in the divided section also is formed differently from one another. Thus, the piezoelectric film loudspeaker having a predetermined area can have a broad band.

10 Claims, 6 Drawing Sheets

PIEZOELECTRIC FILM LOUDSPEAKER

BACKGROUND OF THE INVENTION

1. Field of the Invention

The present invention relates to a piezoelectric film loudspeaker using a flexible piezoelectric film with electrodes formed on both surfaces thereof as a diaphragm.

The present application claims priority from Japanese Patent Application No. 2001-336201, the disclosure of which is incorporated herein by reference for all purposes.

2. Description of the Related Prior Art

In recent years, according to downsizing and thinning a stereophonic apparatus, a television apparatus or the like, a loudspeaker as a sound outputting equipment for them also has been requested to be downsized, thinned down, and lightened. In particular, with regard to the loudspeaker for automobiles, a more compact loudspeaker is needed since there has been requested an enough livability within a vehicle. In addition, since it has been requested for all passengers on the seats to uniformly enjoy sound of an even strength, it is proposed to mount a piezoelectric film loudspeaker which has a thin shape and is light in weight within a vehicle, for example, using a wide and flat surface such as a ceiling of the vehicle.

The conventional piezoelectric film loudspeaker has a shape as shown in FIGS. 6*a*, 6*b*, 7*a* and 7*b*. FIGS. 6*a* and 7*a* are side views, and FIGS. 6*b* and 7*b* are plan views. The piezoelectric film loudspeaker 60 as shown in FIGS. 6*a* and 6*b* has a diaphragm of a a high polymer piezoelectric film 62 with electrodes formed on both surfaces thereof, a curved state of the high polymer piezoelectric film 62 of which is supported by side frames 61 made of metal or plastic. Signals from a terminal 63 are applied to the electrodes formed on the surfaces of the high polymer piezoelectric film 62, thereby generating sound from the surface of the high polymer piezoelectric film 62.

The piezoelectric film loudspeaker 70 as shown in FIGS. 7*a* and 7*b* is provided with a high polymer piezoelectric film 72 with electrodes formed on both surfaces thereof, which abuts on four convex and elastic support bodies. The connecting portion of each elastic support body is provided with a support member 74. The other structures such as a frame 71 and a terminal 34 are the same as ones of FIGS. 6*a* and 6*b*. The piezoelectric film loudspeaker 70, therefore, can be bent at each portion of support members 74, thereby enabling the piezoelectric film loudspeaker 70 to be attached while being bent and transformed in accordance with the shape of the ceiling or the like in the vehicle.

In the conventional piezoelectric film loudspeaker as mentioned above, the electrodes are formed on the both whole surfaces, i.e., front and rear surfaces of the single high polymer piezoelectric film 62, 72. That is, the diaphragm, in which the whole surface of the high polymer piezoelectric film 62, 72 is vibrated by signals from the terminal 63, 73, is formed. Therefore, equivalent circuits for the piezoelectric film loudspeaker are as shown in FIGS. 8*a* and 8*b*. FIG. 8*a* shows the equivalent circuit without a transformer, and FIG. 8*b* shows one with the transformer. In these cases, the signals are supplied from a signal source S to a capacity C which is formed by the single high polymer piezoelectric film 62, 72 directly or through the transformer T.

According to such a conventional piezoelectric film loudspeaker, a plane wave with a single phase can be generated for a desired space since a single surface of diaphragm is utilized, thereby allowing the even level of sound pressure to be gained over the desired space. However, it is difficult for the diaphragm of the single surface of high polymer piezoelectric film to output all the bands (20–20000 Hz) like a dynamic loudspeaker, even if the even level of sound pressure can be output. In particular, the conventional piezoelectric film loudspeaker, in which the periphery of the loudspeaker is supported by the frame and thus the vibration of flat surface is caused, has problems that the distortion of frequency characteristic may occur since a divided vibration is apt to occur when the reproducing frequency of the loudspeaker with the relatively large area is set to be high. Additionally, in the diaphragm which unifiedly supplies signals to the single surface, there is also a problem that the degree of freedom for designing each kind of characteristic is little.

In order to settle these problems, one way is to combine a plurality of high polymer piezoelectric film loudspeakers, wherein each area of the high polymer piezoelectric film is kept to be small. However, in this case, it is difficult to arrange the phase of each piezoelectric film loudspeaker when setting it, and also the increase of cost is caused.

SUMMARY OF THE INVENTION

An object of the present invention for settling the above mentioned problems is to provide a piezoelectric film loudspeaker with a desired area which can be formed into a broad-band, and easily mounted with the improved degree of freedom for designing each kind of loudspeaker characteristic without any cost-up. According to the first aspect of the present invention, there is provided a piezoelectric film loudspeaker comprising a diaphragm having a flexible piezoelectric film and electrodes formed on the both surfaces of the flexible piezoelectric film, and frames for supporting said diaphragm, wherein the respective electrodes disposed on the both surfaces are divided into a plurality of sections.

In the second aspect of the present invention, the plurality of sections as described in the first aspect have a different area one another, respectively.

In the third aspect of the present invention, the surfaces of the flexible piezoelectric film with the electrodes formed thereon, as described in the first aspect, are curved with a different curvature for each of the plurality of sections, respectively.

According to such constructions as claimed, the following operation and effect can be realized. That is, according to the first aspect of the present invention, since the electrodes formed on the both surfaces of the flexible piezoelectric film are divided into a plurality of sections on the surfaces of the film, the piezoelectric film loudspeaker with a small section divided partially is formed through supplying signals into each divided electrode. Thus, the level of divided vibration can be raised, so that a form of the broad band can be brought.

Also, since the sections of divided electrode are formed on a single flexible piezoelectric film, and thus the piezoelectric film loudspeaker formed by the sections is on the same surface, a phase of a plane wave output from each section can be easily adjusted. Therefore, the design of the piezoelectric film loudspeaker can easily performed since the phase adjustment necessitated when setting the loudspeaker using a plurality of films is not necessary in this case. In order to form divided electrodes on a surface of the single flexible piezoelectric film, the electrode material may be evaporated on an overall surface of the film with masks disposed on the film. Namely, substantially the same way as one of forming a single sheet of electrode can be adopted, and so the special cost is unnecessary in order to create the loudspeaker of the present invention.

Further, the degree of freedom for designing various kind of characteristics such as area or curvature, multi-amplifications, or network with the divided sections of electrode can be improved.

According to the second and third aspects of the present invention, the electrode area of each divided section or the curvature of the flexible piezoelectric film is set to be different from each section, and thus the different sound range is enabled to correspond with each divided section, thereby bringing the broad band. Further, since the curvature of the flexible piezoelectric film, which corresponds to each divided section, can be freely set, the characteristic of each section can be smoothly connected, thereby forming a flat reproducing characteristic over a broad band.

In addition, according to the first to third aspects of the present invention, each section of the divided electrode is connected to the signal source or the divided amplifiers in parallel or in series by a network circuit, respectively, thereby bringing the configuration into multi-amplifiers. Thus, using a resonance point in a transformer network, a total impedance can be lowered, and also the operation of multi amplification can bring the characteristic of the high input and high sensitivity.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENT

Figure 1A:
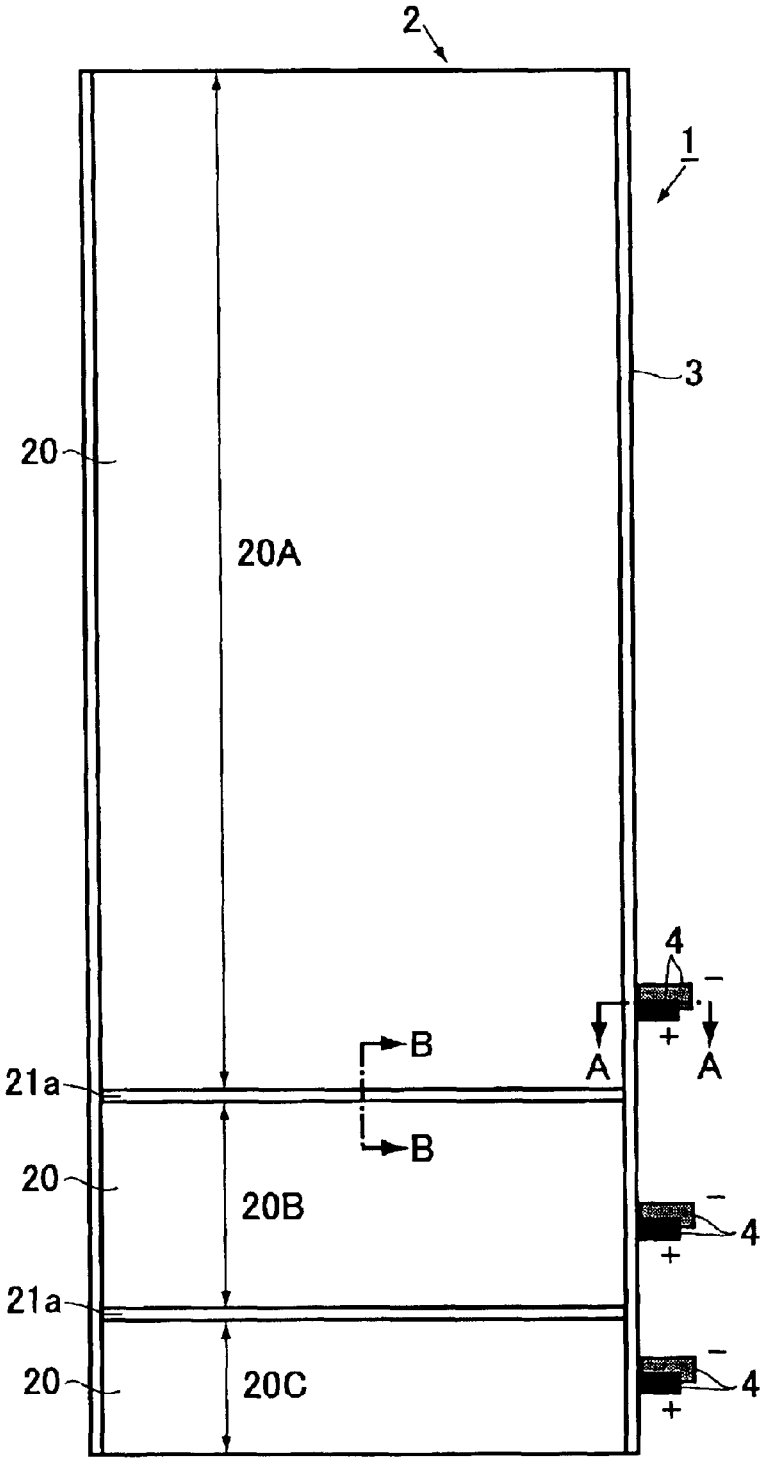
FIG. 1*a* is a plan view of a piezoelectric film loudspeaker of the present invention.
Figure 1B:
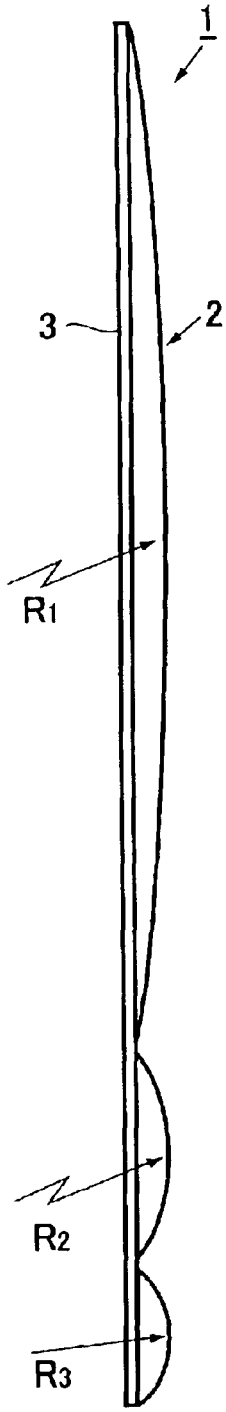
FIG. 1*b* is a side view of the piezoelectric film loudspeaker as shown in FIG. 1*a;*
Figure 2:
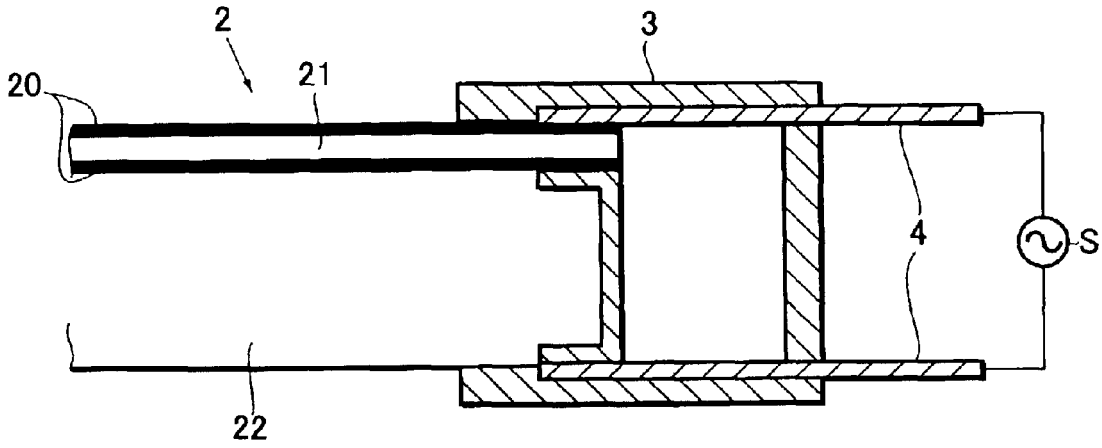
FIG. 2 is a sectional view as taken along a line A—A of FIG. 1*a;*

An embodiment of the present invention will be explained with reference to the attached drawings. FIGS. 1*a* and 1*b* are a plan view and a side view of a piezoelectric film loudspeaker concerned with an embodiment of the present invention, respectively. FIG. 2 is a sectional view as taken along a line A—A of FIG. 1*a*, and FIG. 3 along a line B—B of FIG. 1*a*.

Referring to FIGS. 1*a* to 3, a piezoelectric film loudspeaker 1 comprises a diaphragm 2 structured by a flexible piezoelectric film 21, and frames 3 supporting the both sides of the diaphragm 2. As shown in FIG. 2, the diaphragm 2 has electrodes 20 on front and rear surfaces of the single flexible piezoelectric film 21, and is supported by an elastic support body 22.

Figure 3:
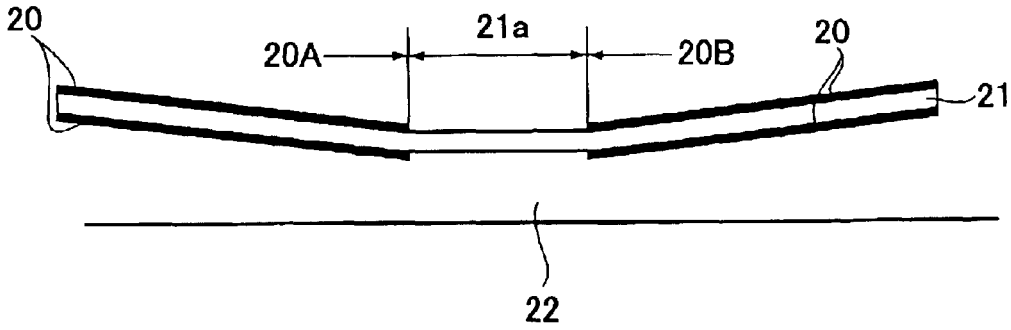
FIG. 3 is a sectional view as taken along a line B—B of FIG. 1*a;*

The electrodes 20 which are formed on the surfaces of the flexible piezoelectric film 21 are divided into a plurality of sections 20A, 20B and 20C. Therefore, anon-electrode portion 21*a*, where the surfaces of the flexible piezoelectric film 21 are exposed, is formed between the adjacent divided sections 20A and 20B, or sections 20B and 20C, respectively. In other words, as shown in FIG. 3, the electrodes 20 are formed only upon the front and rear surfaces of the divided sections 20A, 20B and 20C of the flexible piezoelectric film 21 supported by the elastic supporting body 22. In short, each of the divided sections 20A, 20B and 20C forms an electrode which is independent from each other through the non-electrode portion 21*a*, respectively. Also, a pair of terminals 4 are connected onto each divided section 20A, 20B, 20C as shown in FIG. 1*a*, respectively. Signals from a signal source S are supplied to each divided section 20A, 20B, 20C of the electrode 20 through the terminals 4.

In this embodiment, the area of each divided section 20A, 20B, 20C of the electrode 20 is set to be different from each other, that is, the area of the divided section 20A of one end is largest and ones of the divided sections 20B and 20C are set to be smaller in order thereof. In addition, the radius curvature R1, R2 and R3 of the flexible piezoelectric film 21 in each divided section 20A, 20B, 20C is set to become R1>R2>R3, respectively.

According to the embodiment provided with such a construction, the divided sections 20A, 20B and 20C, in which the electrode 20 is divided, are formed, that is different from a single flexible piezoelectric film. Therefore, signals can be supplied to each small section in which the diaphragm of large area is divided so that a level of divided vibration in each divided section can be lowered. Thus, a reproducing band in each divided section can be spread. Here, applying the divided section 20A with the larger area and curvature radius to a low sound range, the divided section 20B to a middle sound range, and the divided section 20C with the smaller area and curvature radius to a high sound range, a broad band based on a division of band can be achieved using only one sheet of flexible piezoelectric film 21.

In this case, since the area and the curvature can be freely set at each divided section, an optimization of crossover frequency in the divided band corresponding to each divided section is possible. Thus, the reproducing characteristic over the broad band can be connected smoothly.

Also, each divided section 20A, 20B, 20C is on the same plane since it is a portion formed on the surface of one sheet of flexible piezoelectric film 21, and so sound generated from each divided section has a plane wave with a uniform phase. Therefore, while a plurality of loudspeaker units need an adjustment of phase between each other, it is unnecessary in the case of the present invention, thereby enabling the loudspeaker to be easily mounted.

Figure 4:
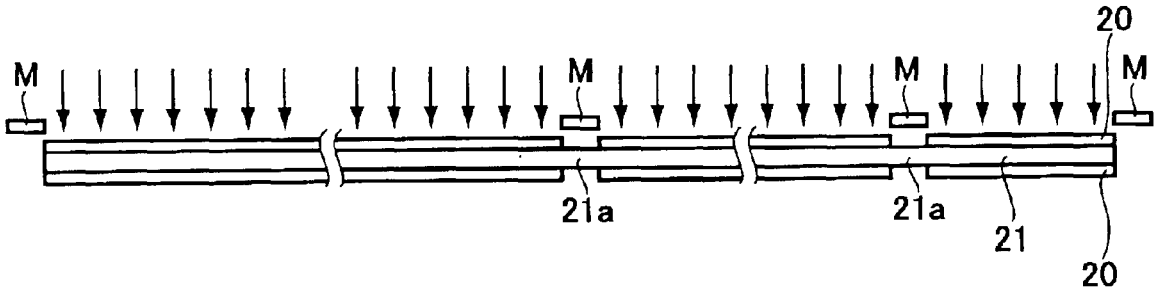
FIG. 4 is an explanatory view showing a way for forming a diaphragm in the present invention.

Next, the way of manufacturing the diaphragm 2 will be described with reference to FIG. 4. That is extremely simple, namely, small masks M are disposed upon a plurality of portions on the flexible piezoelectric film 21 for non-electrode portions, and then electrode material such as aluminum is evaporated onto the film 21 including the mask M along arrows as shown in FIG. 4, which is performed to the both sides of the film 21, thereby forming electrodes 20 on the both surfaces of the film 21. Here, in the portion of each mask M, the non-electrode portion 21*a* is formed. In other words, the diaphragm 2 forming each divided section of electrode can be manufactured in the same fashion as the diaphragm comprising one sheet of electrode, other than using the mask M, so that no extra cost occurs in the manufacturing cost.

The flexible piezoelectric film 21 comprises a high polymer piezoelectric film which is obtained by executing an extension treatment or a polarization treatment to an untreated polyvinylidene fluoride or the like, or a composite piezoelectric sheet which is formed by mixing many piezoelectric elements (piezoelectric ceramic) into a high polymer sheet such as an epoxy resin. As the electrode material other than the aluminum as mentioned above, the materials with high conductivity can be used. In particular, in case of making the diaphragm 2 itself have light permeability, a transparent electrode such as an ITO may be used.

The diaphragm 2 as made in such a way is held in a curved shape with a desired curvature, being supported by the above mentioned elastic support body 22. The elastic support body 22 comprises, for example, a polypropylene foam, a styrene foam, an ABS resin, an aluminum, a polyurethane foam, and the like, and is formed in accordance with each curved shape of the divided sections 20A, 20B and 20C. Although the elastic support body 22 is used in the above mentioned embodiment, the single flexible piezoelectric film 21 itself may be curved in accordance with each divided section without using the elastic support body 22, being supported by the frame 3.

Figure 5A:
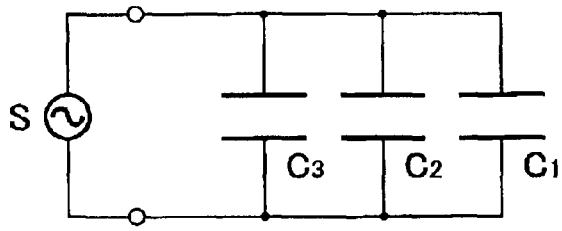
FIGS. 5*a* to 5*d* are equivalent circuit diagrams showing examples of a system for feeding electricity to a piezoelectric film loudspeaker of the present invention.
Figure 5B:
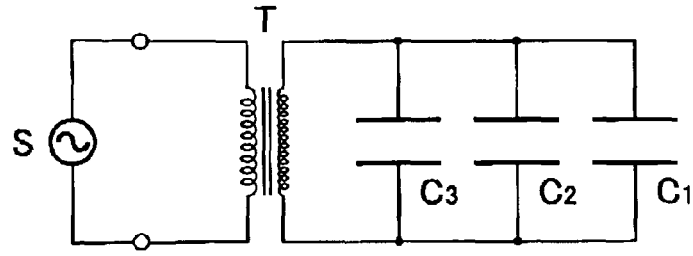
Figure 5C:
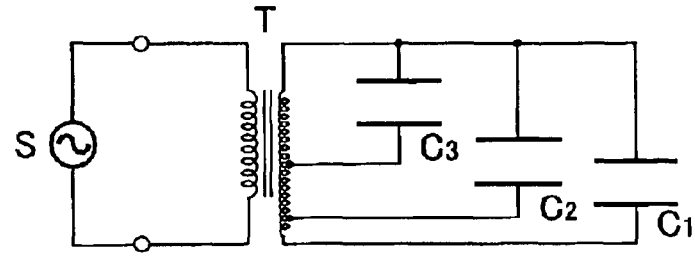

FIGS. 5*a* to 5*d* are equivalent circuit diagrams showing examples of electricity feeding system with regard to the piezoelectric film loudspeaker of the present embodiment. FIG. 5*a* shows an example where capacities C1, C2 and C3, which are respectively formed by the divided sections 20A, 20B and 20C of the electrode 20 in the diaphragm 2, are connected with a signal source S in parallel. FIGS. 5*b* and 5*c* show examples where the capacities C1, C2 and C3, which are respectively formed by the divided sections 20A, 20B and 20C, are connected with the signal source S in parallel or in series through a transformer T.

Figure 5D:
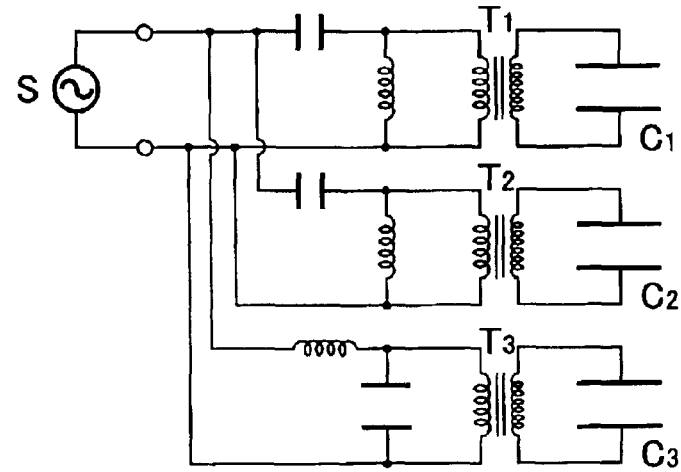
Figure 6A:
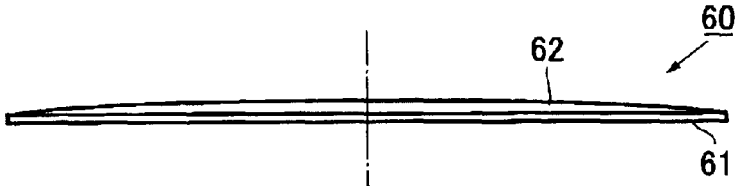
FIG.6 a PRIOR ART
FIG. 6*a* is a side view of a conventional piezoelectric film loudspeaker.
Figure 6B:
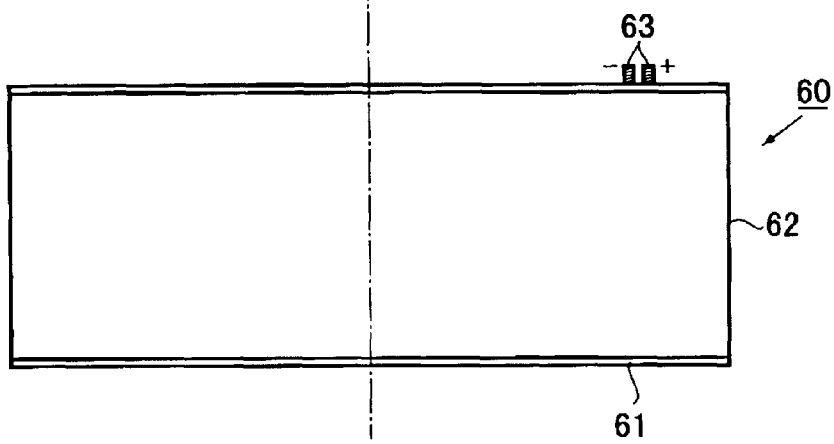
FIG.6 b PRIOR ART
FIG. 6*b* is a plan view of the conventional piezoelectric film loudspeaker as shown in FIG. 6*a;*
Figure 7A:
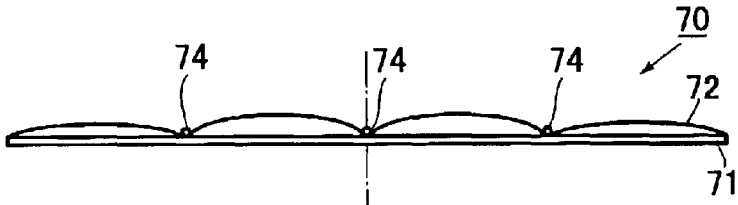
FIG.7 a PRIOR ART
FIG. 7*a* is a side view of the other conventional piezoelectric film loudspeaker.
Figure 7B:
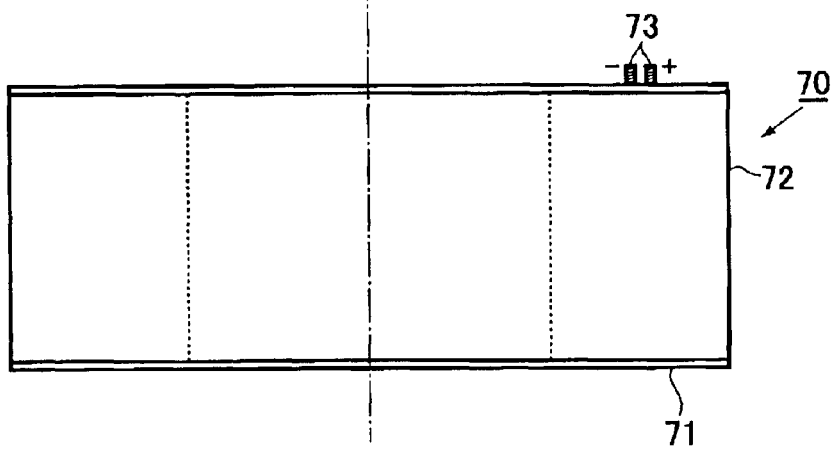
FIG.7 b PRIOR ART
FIG. 7*b* is a plan view of the other conventional piezoelectric film loudspeaker as shown in FIG. 7*a;*
Figure 8A:
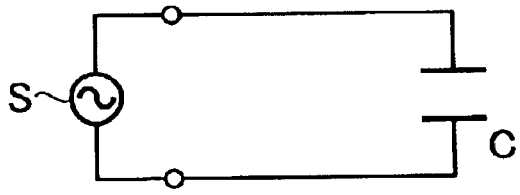
FIG.8 a PRIOR ART
FIG. 8*a* is a diagram for showing an equivalent circuit without a transformer of a conventional piezoelectric film loudspeaker.
Figure 8B:
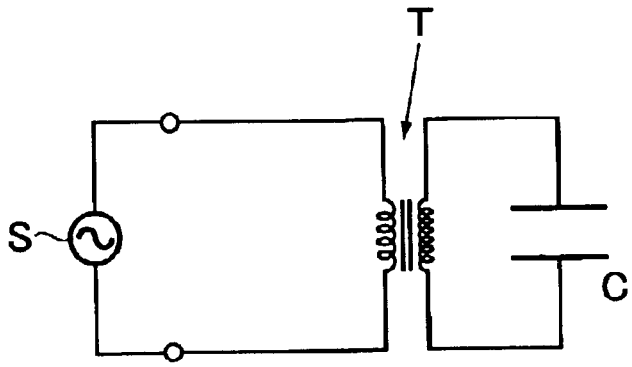
FIG.8 b PRIOR ART
FIG. 8*b* is a diagram for showing an equivalent circuit with a transformer of a conventional piezoelectric film loudspeaker.

FIG. 5*d* shows an example where a network circuit with transformers is formed, and a low pass filter and a high pass filter are inserted between the signal source S (driving amplifier) and capacities C1, C2 and C3 which are respectively formed by each divided section 20A, 20B, 20C, each of which is connected through each transformer T1, T2, T3. In the case that the band is divided into the divided sections 20A, 20B and 20C by such a network, a minute adjustment or the like in each characteristic of a sound pressure frequency, a phase, and an impedance can be performed within the network, so that each divided band can be more smoothly connected, and a preferable broad band can be accomplished.

The divided sections 20A, 20B, 20C of the electrode 20 formed in the diaphragm 2 can be independently driven, and thus a configuration of multi-amplifications also can be applied in the present embodiment. By doing so, not only the degree of freedom of the design for the diaphragm 2 can be enlarged, but also the easy adjustment of the characteristics becomes possible based on the configuration of multi-amplifications. Thus, in addition to the configuration of broad band, high input and high sensitivity can be accomplished.

While the invention has been described in conjunction with preferred specific embodiment thereof, it will be understood that this description is intended to illustrate and not limit the scope of the invention, which is defined by the following claims.

What is claimed is:

1. A piezoelectric film loudspeaker comprising:

a diaphragm having a flexible piezoelectric film and electrodes formed on both surfaces of the flexible piezoelectric film;

frames for supporting said diaphragm; and an elastic support body for supporting said flexible piezoelectric film, wherein said respective electrodes disposed on the both surfaces are divided into a plurality of sections, said plurality of sections having a different area from one another, respectively.

2. The piezoelectric film loudspeaker according to claim 1, further comprising:

non-electrode portions formed between said plurality of respective divided sections, wherein the both surfaces of the flexible piezoelectric film are exposed.

3. A piezoelectric film loudspeaker comprising:

a diaphragm having a flexible piezoelectric film and electrodes formed on both surfaces of the flexible piezoelectric film; and frames for supporting said diaphragm, wherein:

said respective electrodes disposed on the both surfaces are divided into a plurality of sections, said plurality of sections having a different area from one another, respectively;

said plurality of sections, which are divided at least into three, having a different area from one another, respectively;

said surfaces of the flexible piezoelectric film with the electrodes formed thereon are curved with the different curvature for each of said plurality of sections, respectively; and one divided section with the larger area and curvature radius applied to a low sound range, another section with the middle area and curvature radius applied to a middle sound range, and the other section with the smaller area and the curvature radius applied to a high sound range.

4. A piezoelectric film loudspeaker comprising:

a diaphragm having a flexible piezoelectric film and electrodes formed on both surfaces of the flexible piezoelectric film; and frames for supporting said diaphragm, wherein each of said electrodes is divided into sections, each of said sections having a different area from every other section or sections of said each of said electrodes.

5. The piezoelectric film loudspeaker according to claim 4, further comprising:

non-electrode portions formed between adjacent sections of the electrodes, wherein both surfaces of the flexible piezoelectric film in the non-electrode portions are exposed.

6. The piezoelectric film loudspeaker according to claim 4, further comprising:

an elastic support body for supporting said flexible piezoelectric film.

7. The piezoelectric film loudspeaker according to claim 4, wherein:

each of said electrodes is divided into at least three sections, each of said at least three sections having a different area from every other sections of said each of said electrodes;

said surfaces of the flexible piezoelectric film with the electrodes formed thereon are curved with a different curvature radius for each of said at least three sections;

one of said at least three sections having the largest area and curvature radius is applied to a low sound range;

another of said at least three sections having the smallest area and curvature radius is applied to a high sound range; and another of said at least three sections having an intermediate area and curvature radius is applied to a middle sound range.

8. A piezoelectric film loudspeaker, comprising:

a diaphragm having a flexible piezoelectric film having anterior and posterior surfaces, an anterior electrode formed on the anterior surface of the flexible piezoelectric film, a posterior electrode formed on the posterior surface of the flexible piezoelectric film; and frames for supporting said diaphragm, wherein the anterior and posterior electrodes are divided into pairs of sections, both sections of each pair sandwiching the same portion of the flexible piezoelectric film, wherein the surfaces of the portion of the flexible piezoelectric film sandwiched by each pair of the sections are curved with a curvature radius different from curvatures of the surfaces of all other portions of the flexible piezoelectric film sandwiched by other pairs of the sections.

9. The piezoelectric film loudspeaker according to claim 8, further comprising:

non-electrode portions formed between adjacent sections of the electrodes, wherein both surfaces of the flexible piezoelectric film in the non-electrode portions are exposed.

10. The piezoelectric film loudspeaker according to claim 8, wherein the surfaces of all the portions of the flexible piezoelectric film sandwiched by the pairs of sections are curved in the same direction to the frames.

* * * * *